United States Patent [19]

Amann et al.

[11] 4,178,114

[45] Dec. 11, 1979

[54] APPARATUS FOR DIVIDING A FLOCK-LADEN AIR STREAM IN PNEUMATIC TRANSPORTING SYSTEMS FOR SPINNING MACHINES

[75] Inventors: Robert Amann; Werner Lattmann, both of Ohringen; Rudolf Wildbolz, Winterthur, all of Switzerland

[73] Assignee: Rieter Machine Works, Ltd., Winterthur, Switzerland

[21] Appl. No.: 901,485

[22] Filed: May 1, 1978

[30] Foreign Application Priority Data

Apr. 29, 1977 [CH] Switzerland ..... 5336/77

[51] Int. Cl.[2] ..... B65G 53/40

[52] U.S. Cl. ..... 406/155; 406/162

[58] Field of Search ..... 302/28, 64, 59; 19/105

[56] References Cited

U.S. PATENT DOCUMENTS

| | | | |
|---|---|---|---|
| 3,712,682 | 1/1973 | Binder et al. | 302/28 |
| 3,747,985 | 7/1973 | Merkel et al. | 302/28 |
| 3,787,093 | 1/1974 | Hanselmann et al. | 302/28 X |

*Primary Examiner*—Jeffrey V. Nase

*Attorney, Agent, or Firm*—Kenyon & Kenyon

[57] ABSTRACT

A rotatable cylinder or the like is provided between the branch duct and the main transporting duct in order to draw off a part flow of flock-laden air from the main air stream passing through the transport duct. The cylinder may be an integral part of the branch duct or a separate member. Rotation of the cylinder effects withdrawal of a part flow from the transport duct.

21 Claims, 5 Drawing Figures

APPARATUS FOR DIVIDING A FLOCK-LADEN AIR STREAM IN PNEUMATIC TRANSPORTING SYSTEMS FOR SPINNING MACHINES

This invention relates to an apparatus for separating flock from a flock-laden air stream. More particularly, this invention relates to an apparatus for dividing a part flow from a flock laden air stream in a pneumatic transporting system for spinning machines.

As is known, various types of apparatus have been utilized for transporting fiber flocks to various machines. In some cases, use has been made of pneumatic transporting systems in which fiber material is transported through a transport duct in flock form by means of a transporting medium such as an air stream and distributed via one or more branch ducts to various machines such as spinning machines. In order to transport the fiber material to a branch duct on a continuous basis, the flock must be deflected from the transporting air system. For this purpose, various types of devices have been utilized. In one known device, for example as described in U.S. Pat. No. 3,712,682, use has been made of a solid cylinder. In this regard, the cylinder is arranged at the back wall of the branch duct, relative to the direction of material flow in the transport duct, and is rotated about its longitudinal axis at a bias to the direction of material flow. As a result, the air flows around the cylinder and some of the flock in the transport duct is directed into the branch duct. While this construction prevents the occurrence of fiber entanglements at the branch duct points, the aerodynamic properties of the fiber flock transporting system are impaired. That is, by using solid cylinders in the transport duct, the cylinders project partially into the transport duct. Further, there is a risk of a lap-up formation on the cylinder. This can eventually result in a blockage of the cylinder.

Accordingly, it is an object of the invention to insure a disturbance free supply of fiber material in flock form from a pneumatic transport duct to a branch duct.

It is another object of the invention to avoid the occurrence of fiber entanglements or similar disturbances at a branching point of a branch duct from a transport duct of a pneumatic transporting system.

It is another object of the invention to provide an apparatus for dividing a flock-laden air stream in a relatively simple reliable manner.

Briefly, the invention provides an apparatus for dividing a flock-laden air stream in a pneumatic transporting system for spinning machines. The apparatus is comprised of a transport duct for transporting a fiber flock-laden air stream and at least one branch duct which branches from the transport duct at a suitable branch point with a pressure drop between the transport duct and the branch duct. In addition, a rotatable means is mounted at the branch point to direct a part-flow from the transport duct through the branch duct.

In one embodiment, the rotatable means is in the form of a hollow cylindrical member which may have a trumpet shaped end or neck facing the transport duct and a smooth inside surface. Further, the inside diameter of the insert member corresponds to the inside diameter of the branch duct to effect a uniform flow of a part-flow into the branch duct.

In another embodiment, the means may be an integral part of the branch duct. In this case, the branch duct may be relatively short and may constitute a hollow cylinder per se.

The apparatus can be used for supplying various types of branch ducts, opening machines, blending machines of flock feeding machines as well as for supplying chutes which are supplied at the upper end and in which fiber flocks are deposited or from which fiber flocks emerge at a lower end for further transportation.

These and other objects and advantages of the invention will become more apparent from the following detailed description taken in conjunction with the following drawings wherein.

Figure 1:
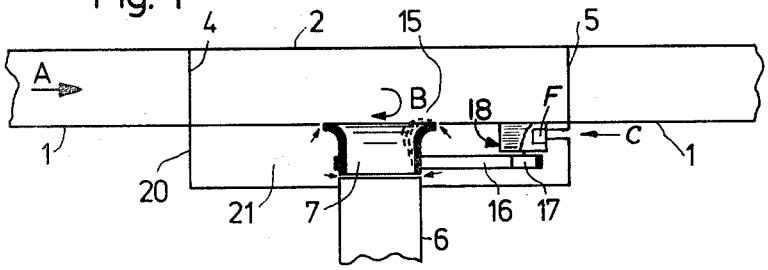
FIG. 1 illustrates a longitudinal sectional view of a pneumatic transporting system having a transport duct and a branch duct connected thereto according to the invention.

Referring to FIG. 1, a pneumatic transporting system includes a transport duct 1 for directing a flock-laden air stream supplied from a suitable fiber flock supplying machine (not shown) in a direction indicated by the arrow A at an air pressure above atmospheric. In addition, a connecting member 2 is inserted in and is connected to the transport duct 1 at opposite ends by flanges 4, 5. The connecting member 2 is sized so as to continue the conveyance of the air stream. Also, a branch duct 6 is connected in suitable manner to the connecting member 2 at a branching point of the transport duct 1 and is disposed on an axis perpendicular to the transport duct 1. This branch duct 6 may lead to any suitable device which is capable of processing, transporting or otherwise receiving the fiber flocks. For example, the duct 6 may lead to an opener, cleaner, transporting apron, spinning machine or a chute which may have an open lower end or a lower end provided with take-off rolls (not shown).

Figure 4:
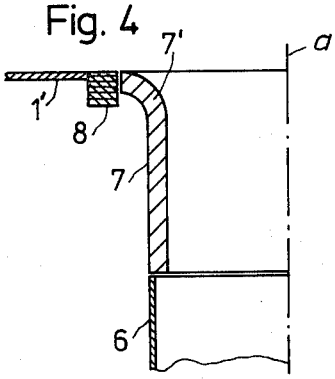
FIG. 4 illustrates an enlarged view of a hollow cylindrical member communicating a transport duct with a branch duct.

In addition, a means is rotatably mounted on the axis of the branch duct 6 for directing a part-flow of the flock-laden air stream through the branch duct 6. This means is in the form of a hollow cylinder 7 which is rotatably mounted in the connecting member 2 coaxially of the branch duct 6. As shown in FIG. 4, the cylinder is separate from the branch duct 6 and has a trumpet-shaped entry at the end adjacent to the transport duct 1 as well as a smooth interior surface.

Referring to FIG. 1, in order to rotate the cylinder 7 a suitable drive mechanism is provided. As shown, the drive mechanism includes an endless belt 16 disposed about the cylinder 7, a pulley 17 about which the belt 16 passes and a motor 18 for driving the pulley 17. The motor 18 is capable of driving the cylinder 7 in the direction indicated by the arrow B or in the opposite direction.

Referring to FIG. 1, the connecting member 2 has a base 1' which acts as a continuation of the base of the transport duct 1 which, for example is horizontally disposed. As shown in FIG. 4, the hollow cylinder 7 is rotatable about an axis of symmetry a which is disposed in the direction of flow of the part-flow air stream and has an end 7′ facing the transport duct 1, i.e. the connecting member 2, which has an upper edge disposed in the plane of the base 1′. In this manner, a good transition from the transport duct 1 to the branch duct 6 is established for the part-flow air stream. Also, the inside diameter of the cylinder 7 corresponds to the inside diameter or dimensions of the branch duct 6. In order to avoid penetration of fiber flocks between the cylinder and 7′ and the base 1′, the clearance between the cylinder 7 and the base 1′ is kept small. In addition, a suitable seal, for example in the form of a ring 8 of felt or other suitable material, may be disposed about the cylinder 7. This ring 8 can be arranged on the base 1′ or on the end 7′ of the cylinder 7 for contact with the other member. A similar seal may also be arranged between the lower end of the cylinder 7 and the branch duct 6. In this way, clogging and impairment of the free rotatability of the cylinder 7 by accumulated fibers can be prevented.

Referring to FIG. 1, use may also be made of a housing 20 in which the connecting member 2, cylinder 7 and drive motor 18 can be disposed as a unit construction. In addition, a cooling fan F may be built into the motor 18 to draw air from the surrounding environment into the housing 20 as indicated by the arrow C. The drawn-in air can be used to generate a pressure drop between a chamber 21 of the housing 20 surrounding the cylinder 7 and separated from the connecting member 2 so that a higher air pressure is maintained in the chamber 21 than in the continuation of the transport duct 1 in the connecting member 2. In this way, the difference in pressure can be used to prevent penetration of fibers between the rotating hollow cylinder 7 and the base 1′.

In operation, a flock-laden air stream flows within the transport duct 1. Under the influence of a pressure drop with respect to the pressure prevailing in the branch duct 6, the air stream flows through the connecting member 2 and a part of the fiber flock is directed into the branch duct 6. The remainder of the flock-laden air stream flows through the connecting member 2 into the remainder of the transport duct 1 and is guided to a further branch duct (not shown) or returns to the fiber flock supplying machine. As the fiber flocks are deflected into the branch duct 6, any fibers 15 sticking to the ends 7′ of the cylinder 7 due to adhesion are carried away from the approach zone or the impact zone, respectively, by the rotation of the cylinder 7. These fibers 15 are then flushed and thereafter carried on into the branch duct 6 or into the transport duct 1. Because of the rotation of the cylinder 7, the flying fiber flocks always touch down on a surface of the cylinder 7 which is free of fibers. By carrying off and flushing the fibers 15 sticking to the cylinder end 7′, the occurrence of fiber entanglements fiber accumulations and similar disturbances are avoided. Thus, a free passage of the fiber flocks into the branch duct 6 is insured at all times.

Figure 2:
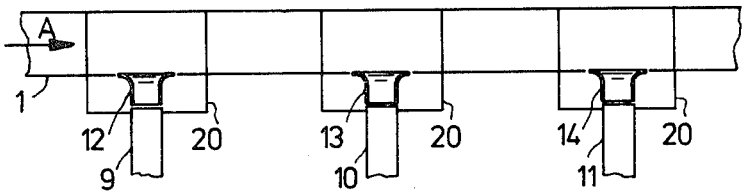
FIG. 2 illustrates a longitudinal sectional view of a pneumatic transport system having a plurality of branch ducts connected to a transport duct according to the invention.

Referring to FIG. 2, the pneumatic transporting system may employ a transport duct 1 with a plurality, for example three, branch ducts 9, 10, 11 which are connected to the transport duct 1 at discreet separated positions along the length of the transport duct 1. As above, these branch ducts 9, 10, 11 may lead to suitable processing equipment. Further, each branch duct 9, 10, 11 is connected to the transport duct 1, via a connecting member, as above, and are constructed in the same manner as the branch duct 6 shown in FIG. 1. Further, a rotatable cylinder 12, 13, 14 is disposed between the transport duct 1 and each branch duct 9, 10, 11 as above.

Figure 3:
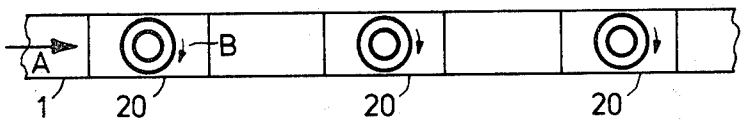
FIG. 3 illustrates a top view of the system of FIG. 2.

During operation, a flock-laden air stream flows from a fiber flock supplying machine (not shown) via the transport duct 1 in the direction indicated by the arrow A. Upon passing over each cylinder 12, 13, 14, a partial air stream containing fiber flock is deflected into the corresponding branch ducts 9, 10, 11. The rotation of the cylinders 12, 13, 14 by a drive mechanism (not shown) in the direction indicated by the arrows B (FIG. 3) insure that any fibers that may stick to the surfaces of the cylinders 12, 13, 14 are torn away or flushed from the cylinder surfaces by the partial air streams deflected towards the branch ducts 9, 10, 11.

Figure 5:
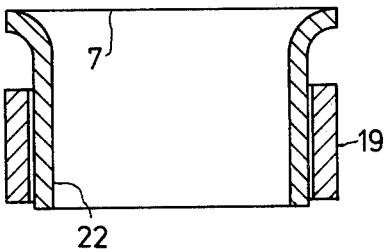
FIG. 5 illustrates a view of a modified cylindrical member and a drive therefor in accordance with the invention.

Referring to FIG. 5, the rotatable hollow cylinder 7 may alternatively be constructed as a rotor 22 with a stator 19 disposed in concentric relationship about the rotor 22. Any suitable means can be used for driving such a cylinder 7.

Further, instead of using a hollow cylinder which is separate from the branch duct 6, the whole branch duct 6, or at least the portion adjacent to the transport duct 1, can be rotatable and provided with a trumpet-shaped end or neck 7′. Also, as indicated in FIG. 5, the branch duct 6 may be of relatively short length so as to form a rotatable cylinder 7 per se.

The invention thus provides a relatively simple construction for deflecting partial flock-laden air streams into a branch duct. Further, the hollow cylinders which are disposed in the transport duct can be disposed in a symmetrical arrangement to permit the transport of fiber material alternately in either direction in the transport duct for take-off at the branching points.

Further, very long staple fibers can be transported and divided out at the various branch ducts without the risk of forming entanglements.

What is claimed is:

1. In combination a transport duct for transporting a flock-laden air stream, at least one branch duct connected to said transport duct to receive a part-flow of a flock-laden air stream passing through said transport duct, said branch duct being connected to said transport duct on a predetermined axis disposed in the direction of the part-flow air stream; and means rotatably mounted on said axis for directing the part-flow from said transport duct through said branch duct.

2. The combination as set forth in claim 1 which includes a plurality of said branch ducts connected to said transport duct at discrete separated positions along the length of said transport duct.

3. The combination as set forth in claim 1 wherein said means is a hollow cylindrical member disposed between said transport duct and said branch duct, said member defining a passage for the part-flow from said transport duct to said branch duct.

4. The combination as set forth in claim 3 wherein said transport duct has a horizontally disposed base and said member is vertically disposed with an upper edge disposed in the plane of said base.

5. The combination as set forth in claim 3 wherein said member has a trumpet-shaped entry at an end adjacent said transport duct.

6. The combination as set forth in claim 1 wherein said branch duct is disposed perpendicularly of said transport duct.

7. In combination a transport duct for transporting a flock-laden air stream;

at least one branch duct in communication with said transport duct on a predetermined axis to receive a part-flow of a flock-laden air stream passing through said transport duct; and means for rotating said branch duct about said axis for directing the part-flow from said transport duct through said branch duct.

8. An apparatus for dividing a flock-laden air stream in a pneumatic transporting system for spinning machines, said apparatus comprising a first duct for transporting a fiber flock-laden air stream; and a branch duct branching off from said first duct at a branch point and with a pressure drop between said first duct and said branch duct, said branch duct being rotatable at said branch point about an axis of said branch duct disposed in the direction of a part flow air stream through said branch duct at said branch point.

9. An apparatus as set forth in claim 8 wherein said branch duct includes a rotatably supported hollow cylinder at said branch point.

10. An apparatus as set forth in claim 9 wherein said cylinder has a trumpet-shaped end facing said first duct.

11. An apparatus as set forth in claim 9 wherein said cylinder has a smooth inside surface.

12. An apparatus as set forth in claim 9 wherein said cylinder has an inside diameter corresponding to the inside diameter of said branch duct.

13. An apparatus as set forth in claim 9 wherein said cylinder is an integral part of said branch duct.

14. An apparatus as set forth in claim 9 which further includes a drive mechanism for rotating said cylinder.

15. An apparatus as set forth in claim 9 wherein said cylinder is a rotor and which further comprises a stator surrounding said rotor.

16. An apparatus as set forth in claim 9 which further comprises a common housing having a connecting member of said transporting duct and said cylinder therein.

17. An apparatus as set forth in claim 16 which further comprises a drive mechanism for said cylinder in said housing.

18. An apparatus as set forth in claim 17 which further comprising a fan combined with said drive mechanism in said housing for drawing in air to generate an above-atmospheric pressure in said housing.

19. In combination, a transport duct for transporting a flock-laden air stream;

at least one connecting member inserted in and connected to said transporting duct;

a branch duct connected to said connecting member to receive a part-flow of a flock-laden air stream passing through said transport duct;

a hollow cylinder rotatably mounted in said connecting member coaxially of said branch duct; and means for rotating said cylinder to effect withdrawal of a part-flow of the flock-laden air stream from said transport duct into said branch duct.

20. The combination as set forth in claim 19 which further comprises a housing having said connecting member, said cylinder and said means disposed therein; said housing defining a chamber surrounding said cylinder and separated from said connecting member and wherein said means includes a fan for generating a higher air pressure in said chamber than in said connecting member.

21. In combination a transport duct for transporting a flock-laden air stream;

at least one connecting member inserted in and connected to said transporting duct;

a rotatable branch duct connected to said connecting member to receive a part-flow of a flock-laden air stream passing through said transport duct, said branch duct being disposed on a predetermined axis disposed in the direction of the part-flow air stream; and means for rotating said branch duct about said axis to effect withdrawal of a part-flow of the flock-laden air stream from said transport duct into said branch duct.

* * * * *